US005331529A

United States Patent [19]

Huang

[11] Patent Number: 5,331,529

[45] Date of Patent: Jul. 19, 1994

[54] ELECTRICAL LAMP BASE SYSTEM

[76] Inventor: Shun-Feng Huang, No. 13, Lane 84, Nei Hu Road, Nei Hu Sub-Ward, Hsin-Chu, Taiwan

[21] Appl. No.: 32,323

[22] Filed: Mar. 17, 1993

[51] Int. Cl.[5] ..... H01R 33/00

[52] U.S. Cl. ..... 362/226; 362/294; 313/318; 439/611

[58] Field of Search ..... 439/611; 313/318; 362/226, 294, 373, 218

[56] References Cited

U.S. PATENT DOCUMENTS

| | | | |
|---|---|---|---|
| 3,089,972 | 5/1963 | Larson et al. | 313/318 |
| 3,611,258 | 10/1971 | Kolakowski | 439/611 |
| 4,180,851 | 12/1979 | Ericson, Jr. | 362/294 |
| 4,567,397 | 1/1986 | Wilhelm et al. | 439/611 |
| 4,872,097 | 10/1989 | Miller | 362/226 |
| 4,985,656 | 1/1991 | Westlund, Jr. et al. | 313/318 |
| 5,010,272 | 4/1991 | Eckhardt et al. | 313/318 |

*Primary Examiner*—James C. Yeung
*Assistant Examiner*—Alan B. Cariaso
*Attorney, Agent, or Firm*—Morton J. Rosenberg; David I. Klein

[57] ABSTRACT

A Christmas lamp with a base has a cylindrical portion formed with a plurality of lengthwise ribs and a plurality of lengthwise slots defined by the ribs. The slots are useful for dispersing heat produced by the lamp quickly. And, inner contact surfaces of the ribs are in close contact with an outer surface of the lamp to keep the lamp secured in the base.

1 Claim, 3 Drawing Sheets

ELECTRICAL LAMP BASE SYSTEM

BACKGROUND OF THE INVENTION

A prior art Christmas lamp shown in FIGS. 4–7 includes a lamp 10 in combination with a base 20 which together are then coupled to a socket 40.

The lamp 10 which has two electrical lead wires 101 extending from it is inserted into a base 20 having a cylindrically shaped lamp receiving chamber with a solid sidewall and two hollow feet 202, 202 extending down from it to allow the two electrical lead wires 101, 101 to pass therethrough. Typically, the diameter of the lamp receiving chamber of the base 20 is greater than that of the lamp 10. Consequently, the lamp 10 may not be held tightly within base 20, diminishing the structural integrity of the lamp 10. Furthermore, the solid sidewall of the lamp receiving chamber prevents the effective dissipation of heat produced by the lamp 10. The solidity of the sidewall may also cause the bulb of the lamp 10 to break when it undergoes heat expansion.

SUMMARY OF THE INVENTION

This invention offers an alternative Christmas lamp and a base wherein a lamp receiving chamber has a plurality of longitudinally directed slots formed through it such that heat produced by the lamp can be better dissipated, and the lamp can be secured more tightly within the base without breakage when the lamp undergoes thermal expansion.

DESCRIPTION OF THE PREFERRED EMBODIMENTS

Figure 3:
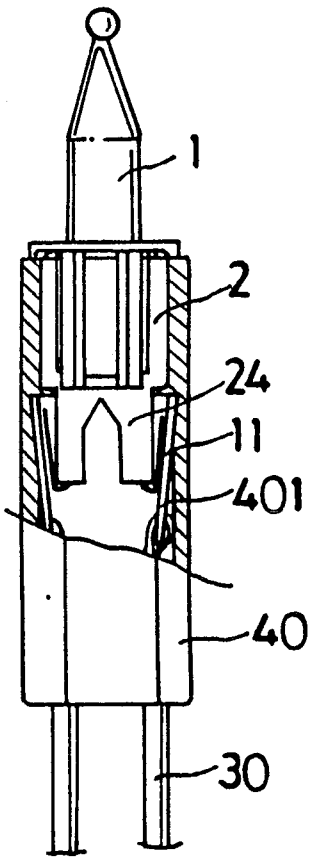
FIG. 3 is a cross-sectional side view, partially cut away, of the lamp base system coupled to a socket.
Figure 2:
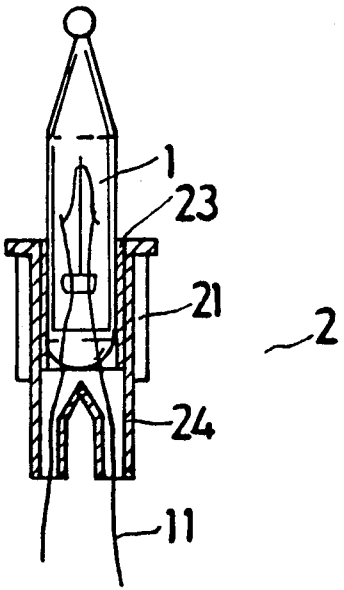
FIG. 2 is a cross-sectional side view of the subject lamp base system of the present invention.
Figure 1:
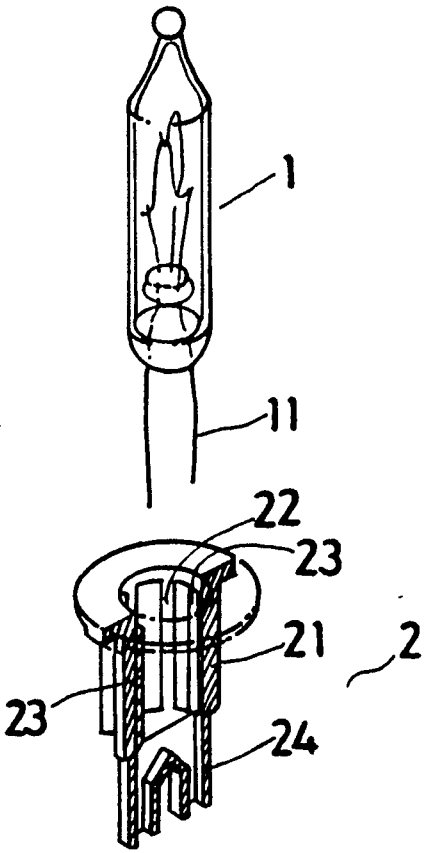
FIG. 1 is a perspective view of a lamp base system of the present invention partially cut away.
Figure 6:
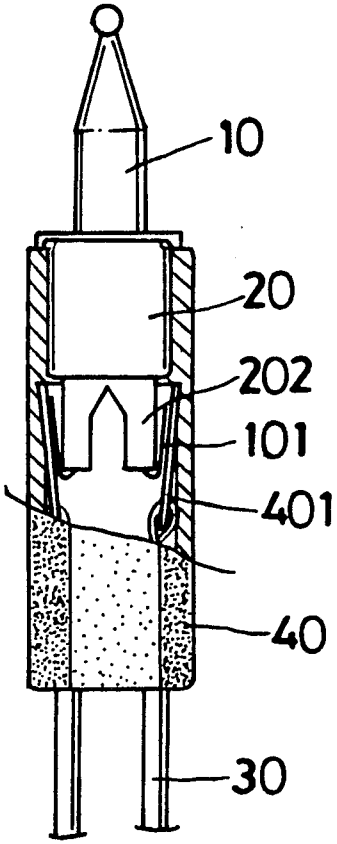
FIG. 6 (PRIOR ART)
FIG. 6 is a cross-sectional side view of a prior art lamp base system coupled to a socket; and, FIG. 7 is a side view of a series of prior art electrical lamp base systems in final assembly.
Figure 5:
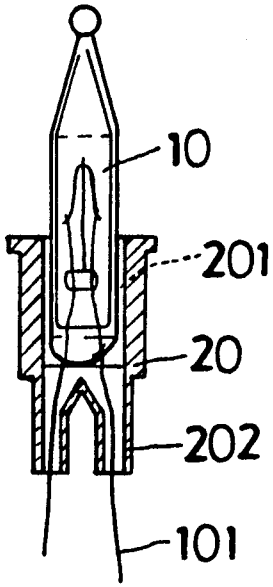
FIG. 5 (PRIOR ART)
FIG. 5 is a cross-sectional side view of a prior art lamp base system.
Figure 4:
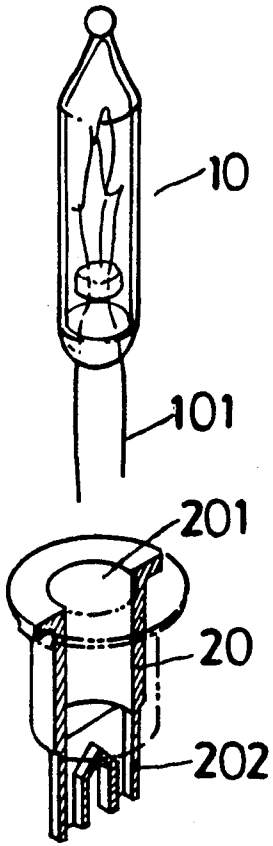
FIG. 4 (PRIOR ART)
FIG. 4 is a perspective view, partially cut away, of a prior art lamp base system.
Figure 7:
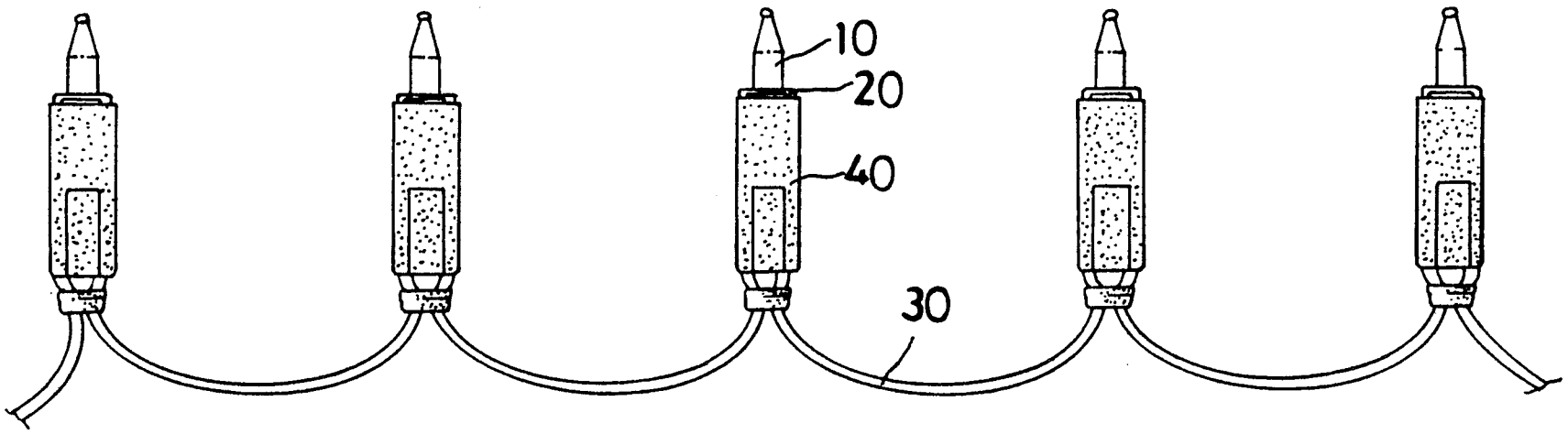
FIG. 7 (PRIOR ART)

A lamp base system having formed in combination a base is shown in FIGS. 1–3 and comprises an electrical bulb or lamp 1 coupled to a base 2. The lamp 1 has two electrical lead wires 11 which extend from electrical bulb 1. The base 2 has a cylindrically shaped bulb receiving chamber with its sidewall defined by a plurality of longitudinal support ribs 21 and a plurality of lengthwise slots 22 which separate the ribs 21. Additionally, there is shown inner contact surfaces 23 of the support ribs 21 and two hollow feet 24 which extend down from the bulb receiving chamber to allow the passage of electrical lead wires 11 therethrough.

The electrical bulb 1 is coupled to the base 2 by insertion into the bulb receiving chamber of base 2 with the outer surface of the section of the electrical bulb i maintaining contiguous contact with the contact surfaces 23 of the base 2. The electrical lead wires 11 of the electrical bulb i extending down from the hollow feet 24 is further shown. The portions of the electrical lead wires 11 protruding from the feet 24 are bent up when the bulb-base combination is received into a socket 40. The lamp system thus assembled allows excellent heat dissipation and consistent structural stability.

When this lamp assembly is coupled to a socket 40 having two cords 30 and conductors 401, an electrical connection is made by the contacts of electrical lead wires 11 with conductors 401. Electrical conduction then occurs when the cords 30 are connected to an electrical source. Heat generated by the electrical bulb 1 will dissipate through the slots 22 of the base 2. This will extend the service life of the electrical bulb 1.

While the preferred embodiments of the invention have been described above, it will be recognized and understood that various modifications may be made therein, and the appended claims are intended to cover all such modifications which may fall within the spirit and scope of the invention.

What is claimed is:

1. An electrical lamp base system comprising:

(a) an elongated electrical bulb having an exterior surface and a pair of electrical leads extending from a lower section of said electrical bulb; and, (b) a cylindrically contoured longitudinally extended base member for insert into a socket, said base member defining an open internal chamber for insert of said electrical bulb therein and a pair of hollow leg members extending from a lower section of said base member forming a pair of lead wire through passages in open communication with said base member open internal chamber, said base member having a sidewall formed by said open internal chamber, said sidewall having a plurality of longitudinally extending slots passing through said sidewalls, said electrical bulb inserted into said base member internal chamber for contiguous contact with an internal surface of said sidewall for providing structural support for said electrical bulb within said base member and allowing heat dissipation through said slots, said pair of lead wires extending through respective hollow leg members and deformed into electrical contact with said socket.

* * * * *